United States Patent [19]

Davidson et al.

[11] Patent Number: 4,907,304

[45] Date of Patent: Mar. 13, 1990

[54] LAMINAR FLOW APPARATUS

[76] Inventors: Peter Davidson, 27308 Pacific Coast Hwy., Malibu, Calif. 90265; S. Gretchen Buck, 8242 W. Third St., Los Angeles, Calif. 90048

[21] Appl. No.: 165,803

[22] Filed: Mar. 9, 1988

[51] Int. Cl.[4] ..... E04H 3/18

[52] U.S. Cl. ..... 4/488; 4/492

[58] Field of Search ..... 4/492, 488, 489, 491, 4/496, 542–544

[56] References Cited

U.S. PATENT DOCUMENTS

| | | | |
|---|---|---|---|
| 1,630,797 | 5/1927 | Marwick | 4/496 X |
| 1,731,554 | 10/1929 | Wheeler | 4/496 X |
| 3,018,491 | 1/1962 | Read | 4/492 |
| 4,665,572 | 5/1987 | Davidson et al. | 4/492 |

FOREIGN PATENT DOCUMENTS

| | | | |
|---|---|---|---|
| 400040 | 5/1968 | Australia | 4/491 |
| 844825 | 6/1970 | Canada | 4/488 |
| 2222594 | 11/1973 | Fed. Rep. of Germany | 4/491 |

*Primary Examiner*—Charles E. Phillips

[57] ABSTRACT

Apparatus is permanently mounted in the deck adjacent to a swimming pool and connected to the water in the pool to generate a laminar flow of water near the surface of the pool at a rate sufficient for exercise and therapy purposes. Two openings are provided in a wall of the pool, one near the surface and one near the bottom. The openings are connected by a flow conduit which includes an arcuately curved section and a straight section, the latter connected to the upper opening. Diffuser vanes are provided along the flow conduit and in the upper opening. A flow generating means, including a rotating impeller disposed within the flow conduit, draws water in through the lower opening, passes it through the flow conduit and past the diffuser vanes, and discharges it through the upper opening as laminar flow.

1 Claim, 1 Drawing Sheet

Figures 1, 2:
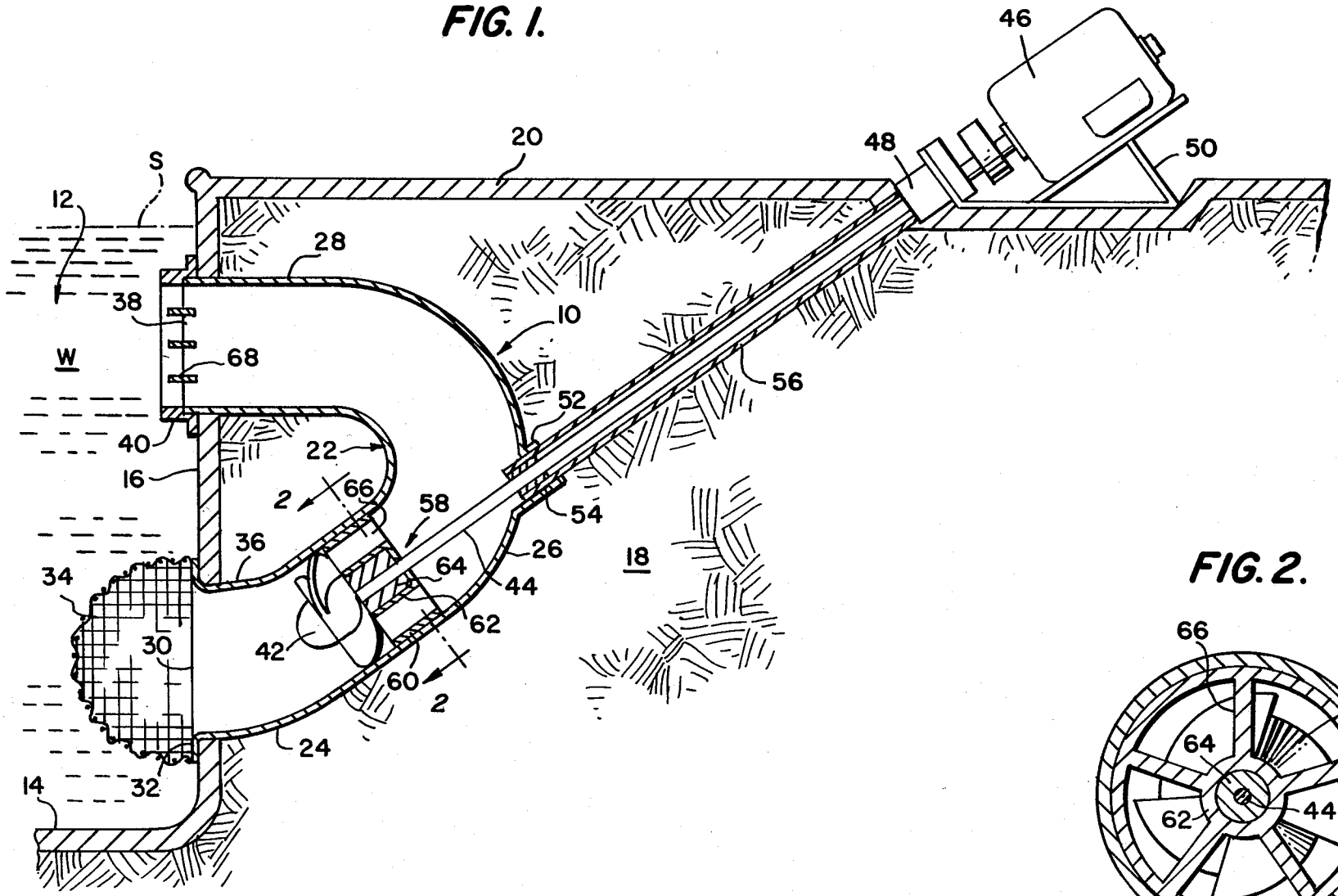

10
12
14
16
18
20
22
24
26
28
30
32
34
36
38
40
42
44
46
48
50
52
54
56
58
60
62
64
66
68
S
W
2

LAMINAR FLOW APPARATUS

This application is related to the invention shown and described in my U.S. Pat. No. 4,665,572, which issued May 19, 1987. In that patent, I disclosed an apparatus which could be inserted in an existing swimming pool, but which was not permanently mounted in any way. By contrast, the present invention discloses a modified form of apparatus, which accomplishes essentially the same purposes, but which is permanently installed, preferably during the construction of the pool itself.

There are numerous forms of prior art devices used for generating currents in bodies of water such as swimming pools. Such devices are described in the aforementioned patent and in the references cited in said patent, and such descriptions, disclosures and references are hereby incorporated by reference. These prior art devices, however, cannot and do not produce a laminar, non-turbulent flow in the manner accomplished by the present invention.

It is therefore an object of the present invention to provide apparatus which produces laminar flow in a confined body of water such as a swimming pool, to enable such laminar flow to be utilized for exercise, recreational and therapeutic purposes.

Another object of the present invention is to provide an apparatus for effectively producing laminar flow in a confined body of water, such as a swimming pool, with which the apparatus is permanently affixed and connected.

Another object of the present invention is to provide an effective, efficient and safe apparatus which can form a permanent part of a swimming pool assembly, and which produces a laminar flow near the surface of the water in such a pool, to enable such laminar flow to be used for exercise, recreational and therapeutic purposes.

Other objects, advantages and salient features of the present invention will become apparent from the following detailed description which, taken in conjunction with the annexed drawings, discloses a preferred embodiment of the invention.

The present invention utilizes a unique and effective flow conduit which is embedded in the ground adjacent to the side of a reservoir or other confined body of water, such as a swimming pool. The flow conduit has a lower section which terminates in a lower or inlet opening in the side wall of the pool, well beneath the surface of the water. The lower section extends angularly upwardly and outwardly from the inlet opening. The flow conduit also includes an upper section which terminates in an upper or outlet opening in the side wall of the pool, near the surface of the water. The upper section extends substantially perpendicularly outwardly from the side wall of the pool, in parallel relation to the surface of the pool water. Diffuser vanes are provided in or adjacent to the outlet opening, with such vanes being disposed parallel to the water surface. The flow conduit also has a center or intermediate section, which is arcuately curved, and which interconnects the upper and lower sections. An impeller is mounted in the lower section of the flow conduit and is connected, via an operating driveshaft, to a drive motor which is mounted a safe distance from the pool water. A radial set of diffuser vanes are mounted adjacent to the impeller. As the drive motor causes the impeller to rotate, water from the pool is drawn into the inlet opening, accelerated through the flow conduit past the radial diffuser vanes, and discharged across the diffuser vanes through the outlet opening. The discharged water forms a laminar flow, at or near the surface of the water, travelling at a rate of at least 2500 gallons per minute and as high as 7500 gallons per minute. This laminar flow can be used for exercise or therapeutic purposes, or even for mere recreational purposes.

Referring now to the drawings, which form a part of this original disclosure:

FIG. 1 is a sectional diagrammatic view showing the apparatus of the present invention in an installed condition; and FIG. 2 is a transverse sectional view taken along the line 2—2 of FIG. 1. In the drawing, the apparatus of the present invention, generally designated 10, is installed adjacent to a reservoir or other confined body of water, advantageously a swimming pool, generally designated 12. The swimming pool 12 includes a bottom 14 and an upstanding side wall 16. The side wall abuts against an embankment 18, normally formed of dirt, which provides support for the side wall 16. The embankment supports a flat upper surface or deck 20 which is normally parallel to, and raised somewhat above, the surface S of the Water W in the pool 12.

The apparatus 10 provides a flow generating means which includes a flow conduit generally designated 22. The conduit is generally circular in cross-section and can be formed of metal or plastic having a generally smooth interior surface. The flow conduit is comprised of interconnected lower, intermediate and upper sections 24, 26 and 28, respectively.

The lower section 24 intersects the pool side wall 16, near the pool bottom 14, and thereby provides a lower or inlet opening 30 through which the pool water communicates with the flow conduit. A collar 32 can advantageously be provided, in attachment with the side wall 16, to secure the end of the lower section 24. A curved screen 34 connects with the collar 32 to prevent debris or any part of a swimmer's anatomy from entering directly into the inlet opening 30. The lower section 24 extends angularly outward from the side wall 16 and upward toward the deck 20. The innermost portion 36 of the lower section 24 is enlarged somewhat where it merges into the inlet opening 30.

The upper section 28 of the flow conduit intersects the pool wall 16 near, but beneath, the surface S of the water and thereby provides an upper or outlet opening 38 through which water from the flow conduit 22 can re-enter the pool 12. A collar 40 attaches the inner end of the upper section 28 to the pool side wall 16. The upper section 28 extends in a horizontal direction, parallel to the water surface S and the deck 20, projecting straight back into the embankment 18, above the lower section 24.

The middle or intermediate section 26 of the flow conduit connects at its upper end with the outer end of the upper flow conduit 28 and at its lower end with the outer end of the lower flow conduit 24. As can be seen, the intermediate section 26 is arcuately curved with the concave portion of the curve facing toward the pool wall 16. The middle section 26 is advantageously permanently connected with the upper and lower sections 28 and 24.

The flow generating means further includes a rotatable impeller 42 mounted on the inner end of an elongated drive shaft 44 which extends angularly upwardly and outwardly until it joins a drive motor 46 and clutch assembly 48, mounted at an angle on the deck 20, by means of a mounting plate 50. The motor and clutch assembly is located a safe distance, e.g. five feet, outwardly along the deck from the pool side wall 16. The angle of disposition of the drive shaft 44 coincides with the central axis of the lower section 24. The drive shaft 44 projects through an opening 52 in the outside of the center section 26. A bushing or support bearing 54 is mounted in the opening, surrounding the drive shaft. A hollow tube 56 surrounds the driveshaft 44 to enable it to rotate freely under the driving action of the motor 46.

The impeller 42 is disposed within the lower section 24 of the flow conduit. Immediately adjacent to the impeller 42, a radial diffuser assembly 58 is disposed within the lower section 24, just adjacent to the location where it joins with the central section 26. The radial diffuser assembly 58 includes an outer ring 60 which attaches to the inner wall of the flow conduit and an inner ring 62 which carries a bushing or thrust block 64 through which the drive shaft 44 passes. A series of radial diffuser vanes 66 extend in spaced relation between the inner and outer rings 62 and 60. The relationship of parts in the radial diffuser assembly is best illustrated in FIG. 2.

An additional set of uniformly spaced diffuser vanes 68 are mounted within and extending across the outlet openings 38. As can be seen, these vanes are disposed in parallel relation to the water surface S.

In operation, the motor 46 rotates the driveshaft 44 and, in turn, the impeller 42. Rotation of the impeller draws water from the bottom of the pool inwardly through the inlet opening 30 and into the lower section 24 of the flow conduit 22. The water is drawn in at a rate of approximately 2500 gallons per minute. As the water passes the impeller 42, it moves across the radial diffusing vanes 66 which accomplishes the first stage of laminarization of the flow. The water then passes through the arcuately curved center section 26 of the flow conduit which accomplishes the second stage of flow laminarization. It then enters the upper section 28 of the flow conduit 22, passing through the upper section and across the diffuser vanes 68 which accomplishes a third stage of laminarization. The water then discharges through the outlet opening 38 as laminar flow, travelling at a rate as high as 7500 gallons per minute, but absent any significant amount of turbulence. The discharging laminar flow, just beneath the water surface S, can be used by a person in the pool as a therapeutic medium, by enabling the flow to pass over an injured or damaged portion of the anatomy, or as a exercise medium by attempting to swim against the flow, or simply as a means of recreation.

One of the important attributes of the present invention is its ability to move the full mass of water in the pool rather than just creating a localized strong current which dissapates a short distance beyond the outlet opening 38. Ideally, the apparatus of the present invention should be positioned along one side of the pool. The discharging laminar flow traverses down that side, across the far end, up the opposite side, and finally across the near end of the pool to return to the inlet opening 30.

While the flow conditions will obviously vary in accordance with the horsepower of the drive motor 46 and the size, shape and volume of the pool, these parameters can be adjusted to achieve the flow rate desired. It has been found that in a rectangular swimming pool 25 meters in length, using a 7½ horsepower motor for the drive motor 46, the discharge velocity from the outlet opening 38 is approximately 10 miles per hour. As that discharging water traverses down one side of the pool and returns up the other side, the return velocity is approximately 3 miles per hour.

While the foregoing detailed description relates to a preferred embodiment of the present invention, it will be understood that various changes and modification apparent to those skilled in the art may be made without departing from the spirit and scope of the invention as defined in the appended claims.

What is claimed is:

1. In an apparatus for generating a laminar flow in a reservoir containing water, the improvement which comprises:

a pair of spaced apertures in one of the walls surrounding and defining said reservoir, with both such apertures being disposed beneath the surface of the water therein;

said apertures providing an upper opening nearest the surface of the water in said reservoir and a lower opening nearest the bottom of said reservoir;

said flow generating means including a flow conduit connecting said upper and lower openings;

flow generating means disposed adjacent to said reservoir and communicating through said openings with the water in said reservoir;

said flow conduit including an upper section aligned with and extending outwardly from said upper opening, said upper section being substantially parallel to the surface of the water in said reservoir;

said flow conduit further including a lower section extending outwardly from said lower opening, said lower section being disposed angularly upwardly;

said flow conduit further including arcuately curved intermediate section interconnecting said upper and lower sections;

said flow generating means further including flow diffusing means with said flow conduit;

said flow generating means further including impeller means disposed within said lower section of said flow conduit;

said flow diffusing means including a first and a second set of vane members;

said first set of vane members being disposed in said lower section between said impeller means and said intermediate section;

said first set of vane members extending radially of said lower section to form a separate series of adjacent flow passages;

said second set of vane members being disposed in said upper section adjacent said upper opening;

said second set of vane members being disposed parallel to the surface of the water in said reservoir;

drive motor means;

means operatively connecting said drive motor means with said impeller means whereby operation of said drive motor means rotates said impeller means and thereby draws water from said reservoir through said lower opening;

said operation of said impeller means further causing said water drawn in through said lower opening to pass through said lower section to and through first set of vane members and said series of adjacent flow passages formed thereby to thus laminarize the flow characteristics of the water;

said operation of said impeller means further causing said water to discharge from said flow passages, to pass through said intermediate section and said upper section, and to pass across said second set of vane members and discharge into said reservoir through said upper opening as non-turbulent laminar flow.

* * * * *